US009610780B2

(12) United States Patent
La Vos et al.

(10) Patent No.: US 9,610,780 B2
(45) Date of Patent: Apr. 4, 2017

(54) METHOD FOR TRANSFERRING A SHEET BETWEEN TWO CONVEYORS

(71) Applicant: OCE-TECHNOLOGIES B.V., Venlo (NL)

(72) Inventors: Peter G. La Vos, Venlo (NL); Johannes H. A. Dinnissen, Venlo (NL); Daisuke Kawaguchi, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/953,199

(22) Filed: Nov. 27, 2015

(65) Prior Publication Data

US 2016/0152045 A1 Jun. 2, 2016

(30) Foreign Application Priority Data

Nov. 27, 2014 (EP) ..... 14195109

(51) Int. Cl.
*B41J 11/00* (2006.01)
*B65H 11/00* (2006.01)
(Continued)

(52) U.S. Cl.
CPC ..... *B41J 11/0005* (2013.01); *B65H 5/021* (2013.01); *B65H 5/224* (2013.01); *B65H 7/06* (2013.01); *B65H 7/16* (2013.01); *B65H 29/242* (2013.01); *B65H 29/56* (2013.01); *B65H 2301/44735* (2013.01); *B65H 2301/51256* (2013.01); *B65H 2404/2691* (2013.01); *B65H 2406/122* (2013.01); *B65H 2511/16* (2013.01); *B65H 2511/416* (2013.01); *B65H 2515/11* (2013.01); *B65H 2515/212* (2013.01);
(Continued)

(58) Field of Classification Search
CPC ..... B41J 11/0005; B65H 29/56; B65H 5/021; B65H 5/224; B65H 7/16; B65H 29/242; B65H 7/06; B65H 2511/16; B65H 2557/64; B65H 2406/122; B65H 2801/15; B65H 2515/81; B65H 2511/416; B65H 2301/44735; B65H 2515/212; B65H 2301/51256; B65H 2404/269
See application file for complete search history.

(56) References Cited

U.S. PATENT DOCUMENTS 6,000,695 A * 12/1999 Mack ..... B41F 21/08 271/183
2004/0245711 A1* 12/2004 Domoto ..... B65H 29/242 271/197
(Continued)

*Primary Examiner* — Bradley Thies
(74) *Attorney, Agent, or Firm* — Birch, Stewart, Kolasch & Birch, LLP

(57) ABSTRACT

A method for transferring a sheet in a sheet transport assembly from a supplying conveyor to a receiving conveyor. The method includes arranging a contact side of a sheet in contact with a transport belt of the supplying conveyor, advancing the sheet on the transport belt in a transport direction along a process unit, which applies a process to a process side of the sheet opposite to the contact side, and to a transfer area where the sheet is transferred to a receiving conveyor. To correct for curl deformation of the sheet, air flow is directed onto the process side of sheet, which urges the sheet towards a supporting element. The air flow is controlled in response to a curl deformation behavior of the sheet.

13 Claims, 6 Drawing Sheets

(51) Int. Cl.

| | |
|---|---|
| ***B65H 5/22*** | (2006.01) |
| ***B65H 7/00*** | (2006.01) |
| ***B65H 29/24*** | (2006.01) |
| ***B65H 7/06*** | (2006.01) |
| ***B65H 7/16*** | (2006.01) |
| ***B65H 5/02*** | (2006.01) |
| ***B65H 29/56*** | (2006.01) |

(52) U.S. Cl.
CPC .... *B65H 2515/342* (2013.01); *B65H 2515/81* (2013.01); *B65H 2557/64* (2013.01); *B65H 2801/15* (2013.01)

(56) References Cited

U.S. PATENT DOCUMENTS

| | | | | |
|---|---|---|---|---|
| 2009/0073211 | A1* | 3/2009 | Imoto ..... | B41J 11/0005 347/16 |
| 2013/0049284 | A1 | 2/2013 | Mandel et al. | |
| 2014/0320575 | A1 | 10/2014 | Kuypers | |

* cited by examiner

METHOD FOR TRANSFERRING A SHEET BETWEEN TWO CONVEYORS

FIELD OF THE INVENTION

The present invention relates to a method for transferring a sheet between two conveyors. The present invention further relates to a sheet transport assembly for transferring a sheet between two conveyors. The present invention further relates to an inkjet printing apparatus comprising the sheet transport assembly according to according to the present invention.

BACKGROUND ART

A known inkjet printing apparatus comprises two conveyors, one supplying a sheet of paper or other material, to a transfer area and one receiving the sheet after being transferred from the supplying conveyor. The supplying conveyor, such as a print belt conveyor having a transport belt for advancing the sheet along an inkjet print station, is arranged for advancing the sheet in a transport direction to a transfer area where the sheet is transferred to the receiving conveyor. Said print station may be arranged for applying an inkjet image onto a process side of the sheet using an ink, such as by applying dots of an aqueous ink.

The supplying conveyor may have a suction mechanism arranged for providing a suction force to attract a contact side of the sheet towards the transport belt, the contact side being opposite to the process side. As such, a holding force is provided for holding the sheet during driving in the transport direction towards the receiving conveyor along with the movement of the transport belt of the supplying conveyor.

The receiving conveyor comprises a transport belt having a support surface for supporting the sheet at a contact side of the sheet. The receiving conveyor may further comprise a suction mechanism arranged for providing a suction force to attract the contact side of the sheet towards the support surface of the transport belt of the receiving conveyor.

When the print station forms an inkjet image on the process side of the sheet by applying dots of an aqueous ink the printed sheet becomes wet due to the aqueous ink dots. The moisture is absorbed into the sheet and enlarges the fibers of the sheet at the process side of the sheet, depending on the sheet properties. As a result, the sheet may curl at the side edges and/or the corners of the sheet and most of the time said curl is downward curl deformation towards the contact side of the sheet. Said curled sheet may provide several problems during transfer of the sheet to the receiving conveyor.

First the downward curled sheet may provide problems during a separation step of the sheet from the transport belt of the supplying conveyor. In a known separation step, the printed sheet is separated from the transport belt by applying a separation air flow to a leading edge of the sheet proximate to a deflection element, such as a roller, which deflection element deflects the transport belt of the supplying conveyor. Said separation air flow is directed along the transport belt adjacent to the deflection element for lifting the leading edge of the sheet from the transport belt at the position of the deflection element.

However a downward curled portion of the sheet, which curl develops after the holding force of the suction pressure is removed, makes it more difficult to separate the leading edge of the sheet from the transport belt. It has been found, that the leading edge of the sheet may be pushed backwards at the deflection element by the separation air flow in a direction opposite to the transport direction, thereby further bending the downward curled portion of the sheet towards the transport belt. As a result, the sheet is not reliably separated from the transport belt, and in the case it is separated, it is not reliably transferred to the receiving conveyor.

Furthermore when the sheet is transferred to the receiving conveyor, the downward curled sheet may land first at curled side edges and/or corners on the transport belt of the receiving conveyor. At the paint the suction mechanism of the receiving conveyor attracts the contact side of the sheet wrinkles may grow in the sheet as the sheet is not allowed to sufficiently flatten on the support surface of the transport belt of the receiving conveyor. These wrinkles may even become fixed in the sheet during a drying step of the printed sheet in a drying unit arranged downstream of the sheet transfer assembly.

In general it is known to flatten an edge portion of a curled sheet by passing an air flow from the center of the sheet over curled edges of the sheet in a direction substantially parallel to a support surface in order to flatten the curled edges of the sheet. However, in all of these steps during transfer of the sheet from the supplying conveyor to the receiving conveyor, curl deformation level of sheets has been found not to be static but time dependent. Furthermore curl deformation may vary considerably over type of sheets and over process conditions, such as environmental conditions, storing conditions of the sheets, process temperature, process speed and ink amount.

When applying such an air flow over a sheet at a lower air flow level, the air flow level may be insufficient to suppress downward curl deformation for a sheet, especially when having a strong curl deformation. Furthermore when applying said air flow over a sheet at a high air flow level, the air flow may disturb the transfer of the sheet, such as not being able to separate a flattened sheet from the transport belt of the supplying conveyor and/or disturbing the alignment of the sheet in the transport direction due to an increased friction between the sheet and the support surface.

SUMMARY OF THE INVENTION

It is accordingly an object of the present invention to provide a method for transferring a sheet during between a supplying conveyor and a receiving conveyor for various sheets, which are inclined to curl downward.

The present invention provides a method for transferring a sheet in a sheet transport assembly from a supplying conveyor to a receiving conveyor, the method comprising the steps of: arranging a contact side of a sheet in contact with a transport belt of the supplying conveyor; advancing the sheet on the transport belt in a transport direction along a process unit, which is arranged for applying a process to a process side of the sheet, the process side being opposite to the contact side, to a transfer area where the sheet is transferred to a receiving conveyor; controlling an air flow directed onto the process side of sheet for urging the sheet towards a supporting element, which supports the sheet during transport in the transfer area, thereby correcting a curl deformation of the sheet, wherein the air flow is controlled in response to at least one sheet attribute comprising a media characteristic of the sheet, wherein said media characteristic defines a curl deformation behavior of the sheet.

The air flow provides a force onto the process side of the sheet, thereby urging the sheet towards a supporting element. The sheet has a tendency for a downwards curl deformation. As the air flow urges the sheet towards the supporting element, the downward curl is restrained, corrected and/or minimized by the air flow. The air flow is controlled in response to at least one sheet attribute comprising a media characteristic of the sheet. Said media characteristic defines curl deformation behavior of the sheet. As such an attribute of the air flow, such as air flow amplitude and/or air flow duration, is adjusted in response to the curl deformation behavior defined by the media characteristic. Accordingly the air flow provides control over curl deformation of sheets having various media characteristics thereby enhancing transfer of these sheets to the receiving conveyor.

If a transferred sheet has a strong tendency to curl, the air flow is adjusted to provide sufficient force to keep the sheet deformation to a manageable level. Another air flow may be used, if a transferred sheet has no tendency to curl.

The media characteristic of the sheet can be any characteristic related to curl deformation behaviour, such as material type, thickness of the sheet, grammage of the sheet, size of the sheet, and/or layers of the sheet, such as coated and uncoated media.

In an embodiment, the air flow controlling step comprises controlling the air flow based on a curl level.

Said curl deformation behavior may be categorized in a curl level, such as heavy curl state, medium curl state and/or low curl state, wherein said curl level may be determined based on a measured downward curl diameter of the sheet, which is attained after a predetermined process treatment (having a predetermined amplitude and time). For example the process treatment may be selected being a maximum ink amount level applied on the process side of the sheet at a certain process temperature and environmental condition.

Said heavy curl state may for example be assigned to the sheet in case the curl radius is less than 20 mm, while said medium curl state may be assigned the the sheet in case the curl radius is between 20 mm and 50 mm.

In an embodiment, the air flow controlling step comprises controlling the air flow based on a stiffness of the curl state.

Said curl deformation behavior may additionally and/or alternatively be categorized in a stiffness of the curl state, such as a rigid curl, a medium stiff curl and a weak curl. The stiffness of cut sheet materials may be measured according to ISO 2493-1:2010.

It is found that said stiffness of the curl state is related to the air flow force which is necessary to keep the curl deformation of the sheet to a manageable level. In case of a rigid curl, the air flow force needed to reduce the downward curl deformation may be higher than in case of a sheet having a weak curl, which may be corrected using a lower air flow force (or shorter air flow duration).

The stiffness of the curl state of a sheet may be determined in a dry state of the sheet and may be determined in a conditioned wet state of the sheet, for example after absorption of a predetermined amount of ink which is typical for the process applied. It is found that absorption of ink in general may considerably reduce stiffness of the sheets.

In an embodiment, the air flow controlling step comprises directing the air flow substantially perpendicular to the process side of the sheet. The direction of the air flow provides effective use of the air flow force to restrain, correct and/or minimize the downward curl of the sheet.

In an embodiment, the sheet advancing step further comprises a step of applying inkjet droplets onto the process side of the sheet. The application of the inkjet droplets effects on the process side effects the internal tension of the sheet, which may lead to a downward curl deformation of the sheet.

In an embodiment, said air flow is further controlled in response to an ink coverage resulting from the applied inkjet droplets. The ink coverage determines to what extend the sheet may become deformed by curl. The ink coverage may be measured in weight per square meters (such as grams per square meter indicated by gsm or g/m2) and may be measured in percentage of a monolayer of Cyan, Magenta, Yellow or Black. In case of a high ink coverage, such as up to 200% for a double monolayer for providing a Red, Green or Blue color, the curl deformation may attain a maximum downward curl. In case of a low ink coverage, such as used for text and/or line drawings, the sheet may have a low curl state, such as having a curl radius of at least 50 mm, being much lower than the maximum downward curl deformation.

In an embodiment, said air flow is controlled based on ink absorption of the process side of the sheet in response to the ink coverage. The air flow is arranged to provide an air force onto the process side for urging the sheet onto the supporting element. The air flow force may disturb the position of ink droplets on the process side of the sheet, in case the ink, which is applied onto the process side, is not sufficiently absorbed by the process side of the sheet. As a result ink bleed may occur due to the air flow applied onto the process side. In this embodiment the air flow may be limited based on a predetermined ink absorption characteristic of the sheet, such that the air flow does not visibly disturb the ink present on the process side of the sheet during application of the air flow.

In an embodiment, the supporting element is the transport belt of the supplying conveyor and the air flow controlling step comprises urging a curled portion of the sheet towards the transport belt.

In an embodiment, the supporting element is a second transport belt of the receiving conveyor and the air flow controlling step comprises urging the contact side of the sheet onto the second transport belt.

In another aspect of the present invention a sheet transport assembly is provided for transferring a sheet between two conveyors, the sheet transport assembly comprising:

i. a supplying conveyor comprising a transport belt, the supplying conveying being configured for advancing the sheet in a transport direction along a process unit, which is configured for applying a process to a process side of the sheet, to a transfer area for transferring the sheet to a receiving conveyor, the sheet having a contact side in contact with the transport belt;

ii. a sheet blowing unit coupled to an air supply source, which sheet blowing unit comprises an air knife arranged for directing an air flow onto the process side of the sheet, the process side being opposite to the contact side, for urging the sheet towards a supporting element for supporting the sheet during its transport in the transfer area;

wherein the sheet transport assembly further comprises a control unit configured for controlling the sheet blowing unit in response to at least one sheet attribute of the sheet comprising a media characteristic of the sheet, wherein said media characteristic defines a curl deformation behavior of the sheet.

The sheet transport assembly and in particular the air knife is controlled according to the method of the present invention in response to a media characteristic of the sheet, which defines curl deformation behavior of the sheet. As the result downward curl deformation is restrained, corrected or at least reduced by the air knife of the sheet blowing unit.

In an embodiment, the control unit is coupled to a media database, which comprises a list of media characteristics related to curl deformation behavior of the sheet. The media database is arranged for providing the media characteristics related to curl deformation behavior of the sheet to the control unit in case the control unit requests the media characteristics for determining the air flow settings of the air knife.

In an embodiment, the air knife is a restrain air knife arranged for directing a restrain air flow onto the process side of the sheet for urging a curled portion of the sheet towards the transport belt of the supplying conveyer. The restrain air knife restricts curl deformation of the sheet, which is supported on the transport belt of the supplying conveyor. Any curl deformation may not further develop in the sheet due to the air flow force applied by the restrain air knife and/or any curl deformation already present may be reduced by the air flow force applied by the restrain air knife. As a result separation of the sheet from the transport belt of the supplying conveyor may be enhanced by the reduced curl deformation of the sheet.

In an embodiment, the sheet blowing unit further comprises a landing air knife arranged for applying a landing air flow onto the process side of the sheet to urge the contact side of the sheet onto a transport belt of the receiving conveyor.

In another aspect of the present invention an inkjet printing apparatus is provided comprising the sheet transport assembly according to the present invention and a print station comprising a print head assembly configured for in operation applying inkjet droplets on the process side of the sheet, which is arranged on the transport belt.

Further scope of applicability of the present invention will become apparent from the detailed description given hereinafter. However, it should be understood that the detailed description and specific examples, while indicating embodiments of the present invention, are given by way of illustration only, since various changes and modifications within the scope of the present invention will become apparent to those skilled in the art from this detailed description.

BRIEF DESCRIPTION OF THE DRAWINGS

Hereinafter, the present invention is further elucidated with reference to the appended drawings showing non-limiting embodiments and wherein.

DETAILED DESCRIPTION OF EMBODIMENTS

Figure 1:
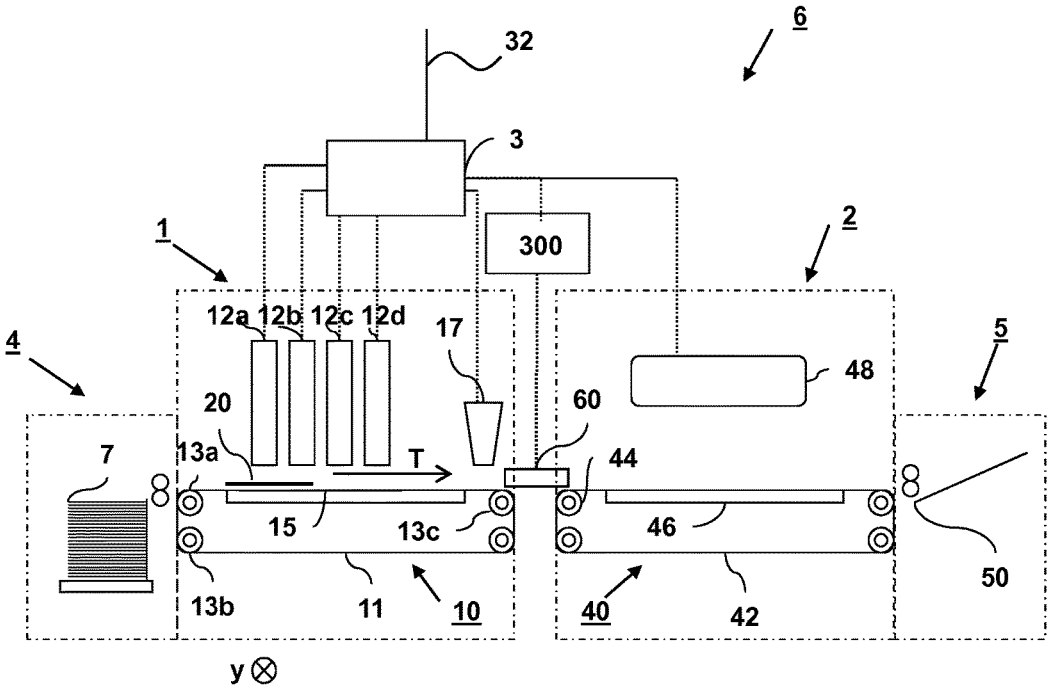
FIG. 1 shows a cut sheet image forming system, wherein printing is achieved using a inkjet printing system.

The present invention will now be described with reference to the accompanying drawings, wherein the same reference numerals have been used to identify the same or similar elements throughout the several views.

In FIG. 1 an inkjet printing system 6 is shown. The inkjet printing system 6 comprises an inkjet marking module 1, an inkjet print drying module 2 and a data controller 3. The controller is connected to a network through a network cable 32. The print data enters the controller through the network and is further processed. The print data can be saved on a non-volatile memory like a hard disk and sent to the inkjet marking module 1 using an interface board (not shown).

A cut sheet supply module 4 supplies a receiving medium 20 to the inkjet marking module 1. In the cut sheet supply module 4 the receiving medium is separated from a pile 7 and brought in contact with the transport belt 11 of the supplying conveyor 10 of the inkjet marking module 1. The supplying conveyor 10 further comprises an assembly of belt rollers 13*a*-13*c*.

The inkjet marking module 1 comprises an assembly of four color inkjet print heads 12*a* 12*d*. The transport belt 11 transports the receiving medium 20 to the area beneath the four color inkjet print heads 12*a*-12*d*. The colors provided by the inkjet print heads 12*a*-12*d* is black, cyan, magenta and yellow. When receiving the print data, the inkjet print heads 12 each generate droplets of inkjet marking material and position these droplets on the receiving medium 20.

The transport belt 11 is transported by the assembly of belt rollers 13*a*-13*c*. The transport belt 11 is transported by one roller belt roller 13*a* in the transport direction of T, and the position of the transport belt 11 in the direction Y is steered by means of another belt roller 13*b*. The transport belt 11 comprises holes and the receiving medium 20 is held in close contact with said belt 11 by means of an air suction device 15. After the inkjet marking material has been printed on the receiving medium, the receiving medium is moved to an area beneath a scanner module 17. The scanner module 17 determines the position of each of the four color images on the receiving medium 20 and sends this data to the data controller 3.

The receiving medium 20 is transported to by the supplying conveyor 10 towards a receiving conveyor 40 of the inkjet print drying module 2. The receiving conveyor 40 of inkjet print drying module 2 comprises a transport belt 42, which is transported by an assembly of belt rollers 44 in a direction of R. The receiving medium 20 is attracted to the belt 42 by means of a suction unit 46. The receiving medium 20 is dried by the heater device 48. The dried print product is made available on a tray 50 in the print storage module 5. In between the supplying conveyor 10 and the receiving conveyor 40 a sheet transfer assembly 60 is arranged for transferring a sheet from the supplying conveyor 10 to the receiving conveyor 40. Said sheet transfer assembly 60 may for example be the sheet transfer assembly according to the present invention.

Figure 5A:
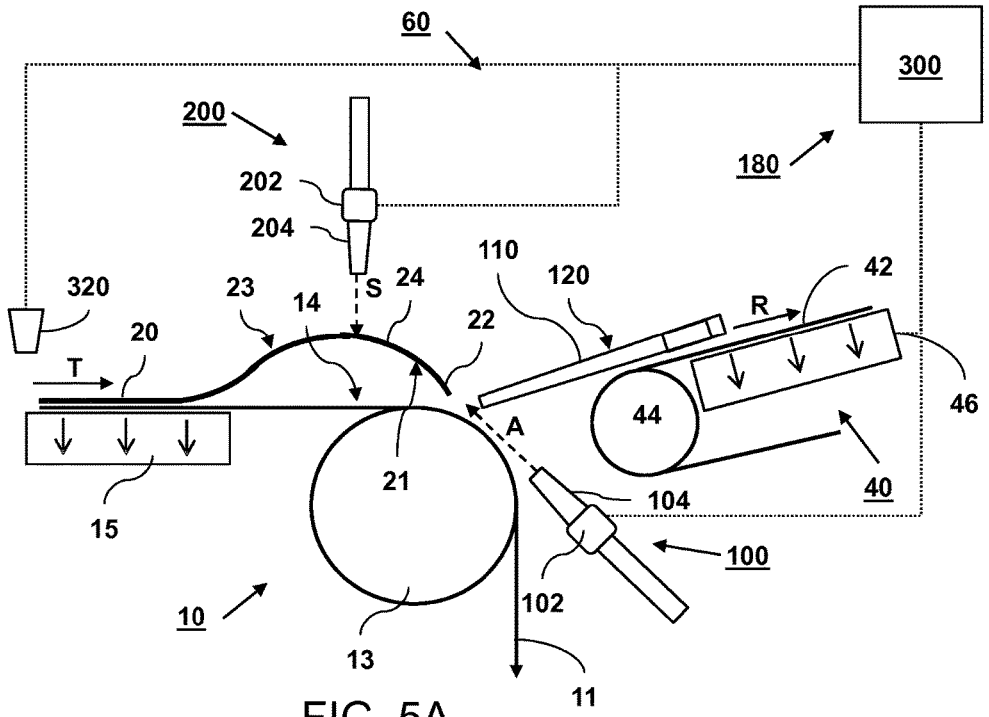
FIGS. 5A-5B show a sheet separating unit for separating a sheet from the transport belt of the supplying conveyor operated according to the method of the present invention.
Figure 5B:
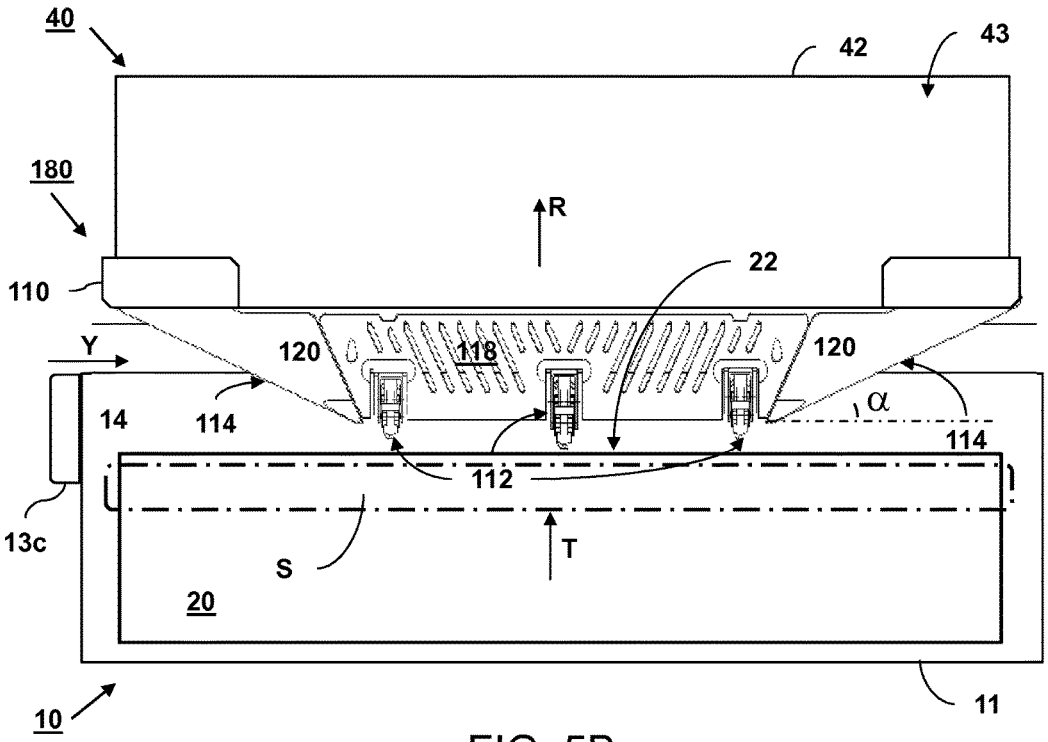

The sheet transfer assembly 60 according to an embodiment of the present invention is controlled by a control unit 300 and may comprise a sheet separating unit 180 for separating a sheet from the transport belt 11 of the supplying conveyor 10 as is further explained in relation to FIGS. 5A-5B.

Figure 6A:
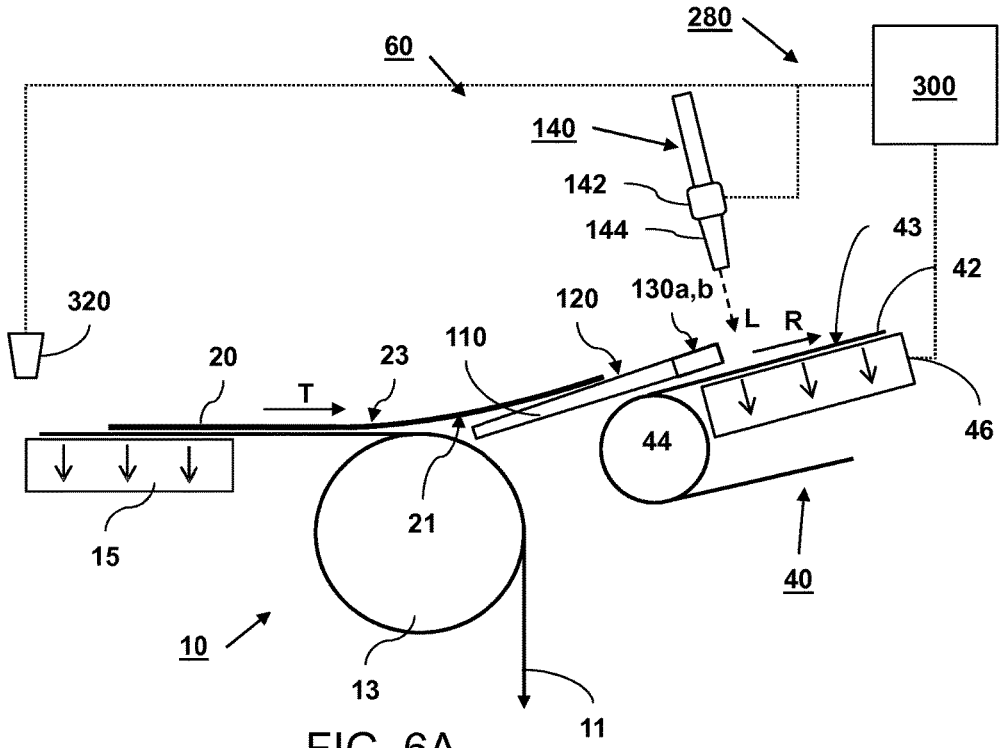
FIGS. 6A-6B show a sheet landing unit for moving the sheet onto the transport belt of the receiving conveyor operated according to the method of the present invention.
Figure 6B:
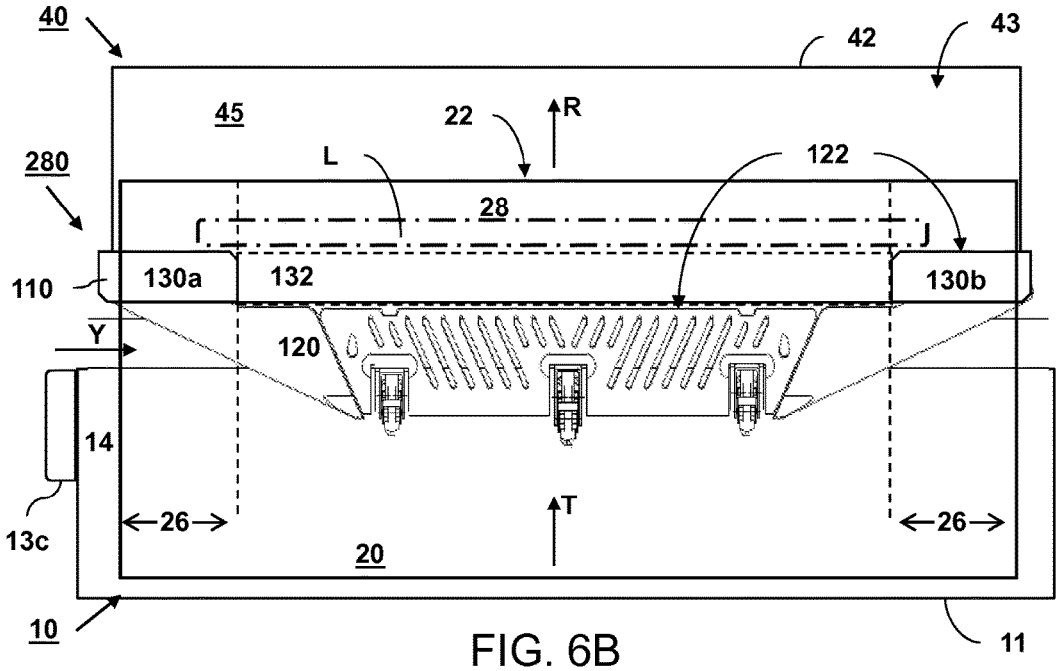

The sheet transfer assembly 60 according to an embodiment of the present invention, which is controlled by the control unit 300 may comprise a sheet landing unit 280 for moving the sheet onto the transport belt 42 of the receiving conveyor 40 as is further explained in relation to FIGS. 6A-6B.

The sheet transfer assembly 60 according to an embodiment of the present invention, which is controlled by the control unit 300, may comprise the sheet separating unit 180 as is shown in FIGS. 5A-5B and additionally the sheet landing unit 280 for moving the sheet onto the transport belt 42 of the receiving conveyor 40 as is shown in FIGS. 6A-6B. In this embodiment the control unit 300 controls the air knifes 100, 200 of the sheet separating unit 180 and the landing air knife 140 of the sheet landing unit 280. The sheet guidance element 110 comprises all of the features of both the embodiments shown in FIGS. 5A-5B and FIGS. 6A-6B.

Figure 2:
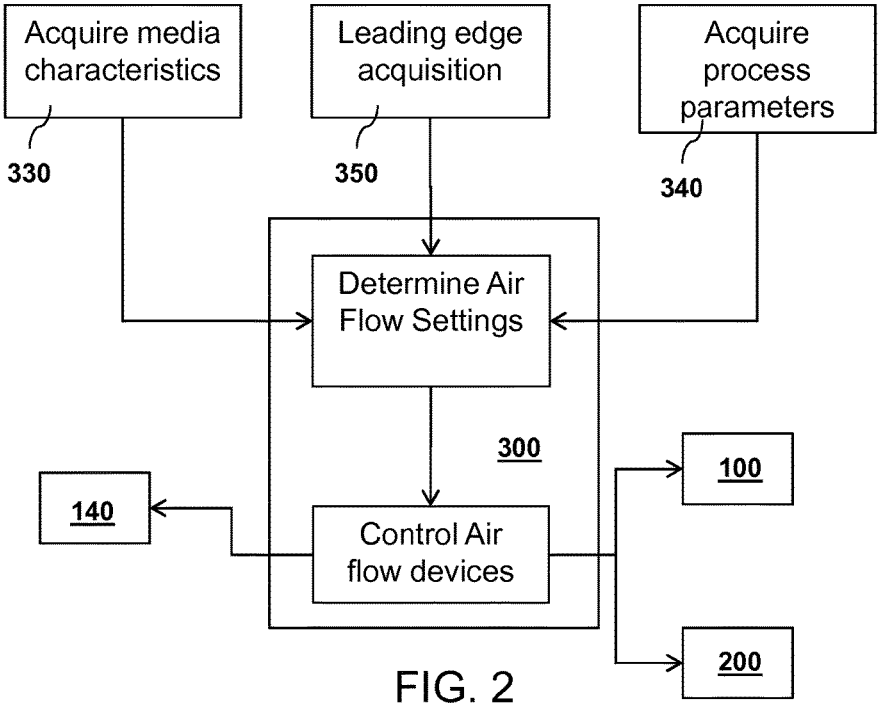
FIG. 2 shows a block diagram of a control system comprising a control unit operating according to embodiments of the method of according to the present invention.

Now referring to FIG. 2 showing a block diagram of a control system comprising a control unit operating according to the method of the present invention. The control unit 300 controls the air flows, as shown in block diagram, provided by each air knife 100, 200 and/or 140 in respect of air flow settings, such as air flow pressure [bar], air flow volume [l/min], air flow speed [m/s] and air flow timing [millisecond]. The air flow pressure is controlled in the range of 0-5 bar. The air flow volume is controlled in the range of 0-200 U/min per air flow knife. The air flow volume depends on the air flow restrictions of the respective air knifes and on the air flow pressure. The air flow speed is controlled in the range of 0-50 m/s and also depends on the air flow restrictions of the respective air knifes and on the air flow pressure.

The air flow timing of the respective air knifes 100, 200 is important for the functioning of the separating unit 180. The air flow timing of the respective air knife 140 is important for the functioning of the sheet landing unit 280.

The control unit 300 determines the air flow timing [millisecond] of the respective air knifes 100, 200 and/or 140 based on media characteristics 330 of the sheet 20 and/or based on process parameters 340 of the sheet 20, such as advancing speed of the transport belt 11 in the transport direction T and such as ink coverage of the sheet 20 based on print data and droplet sizes used. All of the process parameters 340, such as the ink coverage of the sheet, are provided to the control unit 300 by a process controller, such as the data controller 3 indicated in FIG. 1. Furthermore the control unit 300 determines a starting timing [millisecond] of the air flow timing in response to receiving a leading edge acquisition 350 from the sensor 320 (as is shown in FIGS. 5A and 6A). As a result the air flow timing [millisecond] is based on the position of the leading edge of the sheet.

Examples of media characteristics 330 are heavy coated paper, plain paper, coated offset paper, grammage of the media (e.g. in g/m2), or any other relevant media characteristics 330 which are related to curl deformation behavior of the sheet 20 due to internal tension in the sheet, which is generated in the sheet in response to a treatment applied by a process unit to the process side of the sheet, such as an ink coverage provided by the inkjet marking module 1 shown in FIG. 1.

Figure 3A:
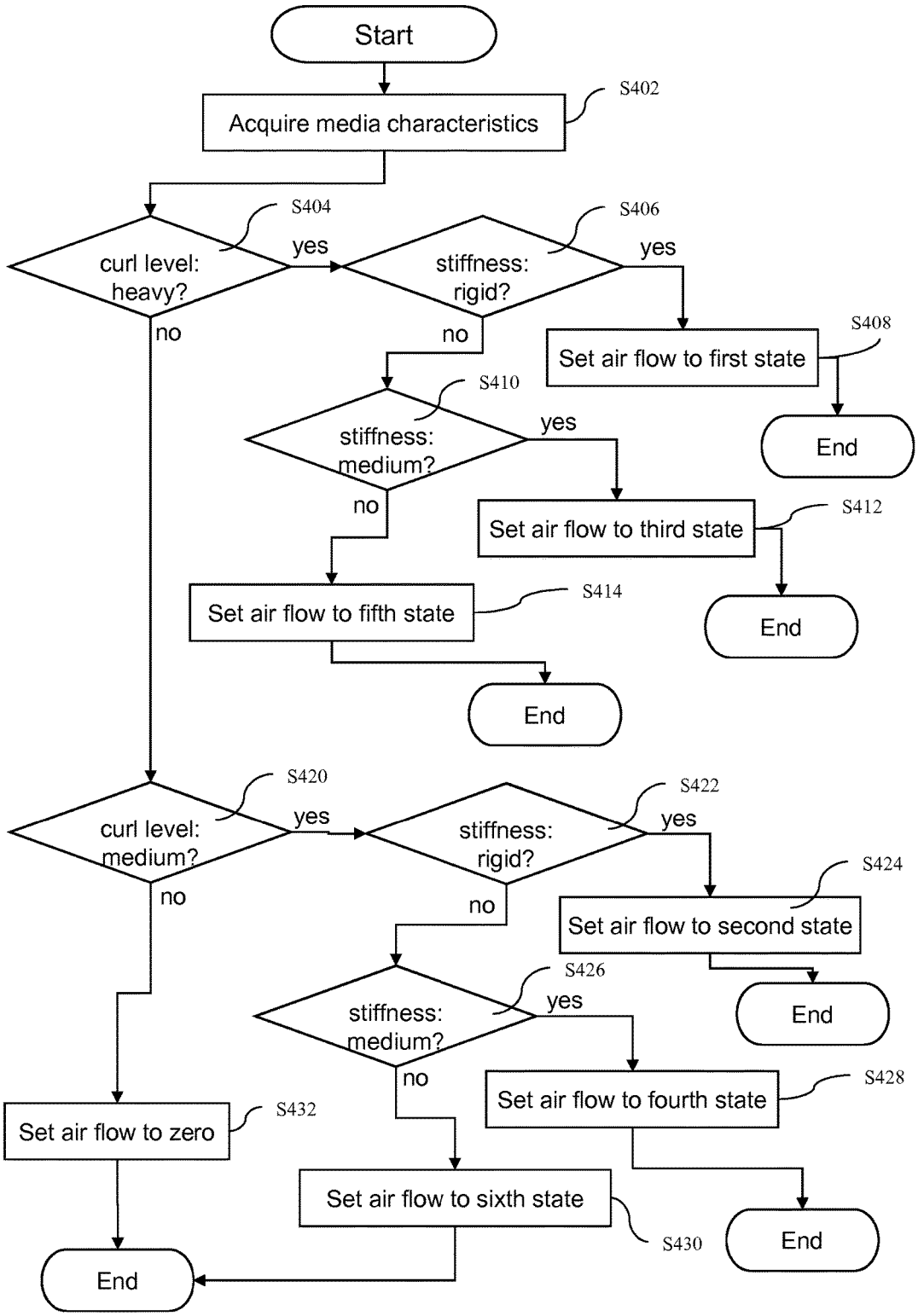
FIG. 3A shows in a flow diagram an embodiment of the method of according to the present invention.

Now referring to FIG. 3A which shows in a flow diagram an embodiment of the method according to the present invention. In case a sheet is processed by the control unit 300 in a first step S402 the control unit 300 acquires media characteristics for said sheet from a media database comprising media characteristics. The media database may be present inside the control unit 300 and may available on a remote data storage unit, which is connected to the control unit 300.

In step S404 it is judged whether the sheet is categorized in respect of curl level as having a heavy curl state. In this embodiment a heavy curl state is for example a sheet having a curl radius of less than 20 mm after a maximum ink amount has been applied on the process side of the sheet (in this example 10 g/m$^2$), which is similar to 200% ink coverage of the sheet with respect to a monolayer amount of an ink type (cyan, magenta, black or yellow).

In case yes, in a next step S406 it is judged whether the sheet is categorized in respect of stiffness of the curl state as having a rigid curl. In this embodiment the stiffness is measured according to ISO 2493-1:2010 in mN, wherein the bending angle is 15° and the bending length is preferably 10 mm or 50 mm. Alternatively the stiffness may be determined by measuring an elastic modulus $E_{mod}$ of the sheet and calculating the stiffness S of the sheet according to the formula: $S=E_{mod}\times I_x=1/12\times E_{mod}\times b\times h^3$, wherein h is a thickness of the sheet [m] and having a basis b [m].

In this embodiment a rigid curl is for example for a dry sheet having an elastic modulus which is higher than 6000 MPa (determined for a room temperature of 23° C. and a Relative Humidity of 30%) and having a thickness of at least 50 microns.

In case yes, in step S408 the air flow level is set to a first state I. The first state I is for example a high air flow velocity being at least 30 m/s and/or an air flow duration of at least 75 millisecond.

In case no in a next step S410 it is judged whether the sheet is categorized in respect of stiffness of the curl state as having a medium stiff curl. In case yes, in step S412 the air flow level is set to a third state III. The third state III is typically an air flow velocity and/or air flow duration which is lower than of the first state I.

In case the answer in step S410 is no, it is assumed that the sheet is categorized in respect of stiffness of the curl state as having a weak curl. In a next step S414 the air flow level is set to a fifth state IV. The fifth state IV is typically an air flow velocity and/or air flow duration which is lower than of the third state III.

In case in step S404 the curl level of the sheet is judged to be not a heavy curl state, in a next step S420 it is judged whether the sheet is categorized in respect of curl level as having a medium curl state. In this embodiment a medium curl state is for example a sheet having a curl radius between 20 mm and 50 mm after a maximum ink amount has been applied on the process side of the sheet (in this example 10 g/m$^2$), which is similar to 200% ink coverage of the sheet with respect to a monolayer amount of an ink type (cyan, magenta, black or yellow).

In case yes, in a next step S422 it is judged whether the sheet is categorized in respect of stiffness of the curl state as having a rigid curl. In case yes, in step S424 the air flow level is set to a second state II. The second state II is for example in between the first state I and the third state III in respect to air flow amplitude and/or duration. Alternatively the second state II may be set to be equal to the first state I. In this embodiment the second state II provides an air flow being higher in amplitude and/or duration than necessary. This simplifies the control of the air flow settings while maintaining proper run ability of the various sheets having different media characteristics, such as maintaining proper transport in the transport direction T without slowing down the sheet and/or disturbing an alignment of the sheet with respect to the transport direction.

In case the answer in step S422 is no in a next step S426 it is judged whether the sheet is categorized in respect of stiffness of the curl state as having a medium stiff curl. In case yes, in step S428 the air flow level is set to a fourth state IV. The fourth state IV is for example in between the third state III and the fifth state V in respect to air flow amplitude and/or duration. Alternatively the fourth state IV may be set to be equal to the third state III. In this embodiment the fourth state IV provides an air flow being higher in amplitude and/or duration than necessary and it is assumed that the stronger air flow, which effectively reduces the downward curl, does not restrict the run ability of the sheet in another way. In case the air flow of the third state III would restrict the run ability for the sheet having the fourth state IV, for example due to too much friction during transport along the support element or preventing a proper separation step from said support element, the air flow state IV is maintained as such and the air flow is not increased in amplitude and/or duration.

In case the answer in step S426 is no, it is assumed that the sheet is categorized in respect of stiffness of the curl state as having a weak curl. In a next step S430 the air flow level is set to a sixth state VI. The sixth state VI is typically the lowest level in air flow amplitude and/or duration. In many cases the sixth state VI of sheets may even be made equal to an air flow level of zero 0, thus applying no air flow as the transfer of the sheet is tolerant to the curl level, as is indicated by arrow 0' in FIG. 3B. Many light weight machine coated papers are assigned to the sixth state VI which is modified to the zero level 0' as they do not need an air flow force for the transfer to a next conveyor.

In case the answer in step S420 is no, it is assumed that the sheet is categorized in respect of curl level as having substantially no curl. In a next step S432 the air flow level is set to zero 0.

Now referring to FIG. 36 showing a schematic diagram illustrating the air flow states as indicated in FIG. 3A depending on curl level and stiffness of the curl state of the sheet.

In the diagram a curl level forms a vertical axis of the diagram having the category heavy curl state on top of the category medium curl state. In the diagram a stiffness of the curl state forms a horizontal axis of the diagram having the categories rigid curl, medium stiff curl and weak curl in order from left to right. The first state of the air flow level is indicated by I, the second state of the air flow level is indicated by II, the third state of the air flow level is indicated by III, the fourth state of the air flow level is indicated by IV, the fifth state of the air flow level is indicated by V, the sixth state of the air flow level is indicated by VI and the zero level of the air flow is indicated by O.

A stiffness of the curl state is determined by media characteristics of a sheet. For example it has been found that the weight of plain paper sheets (in grams per square meter) provides an indication of the stiffness of the curl state. For example in the diagram shown in FIG. 3B plain papers having a weight in the range of 50-70 gsm may be categorized as having a weak curl, plain papers having a weight in the range of 70-110 gsm may be categorized as having a medium stiff curl, and plain papers having a weight of at least 110 gsm may be categorized as having a rigid stiff curl.

In Table I examples are shown of the assignment of an air flow state to various cut sheet materials based on curl level of the sheet and on stiffness of the curl state of the cut sheets materials.

TABLE I assignment of air flow states to various cut sheet materials

| Sheet name | Cut sheet type | Curl level | Stiffness | Air Flow State | Critical for runnability |
|---|---|---|---|---|---|
| Lettura Print Matt | plain paper 60 gsm | heavy | low | V | yes |
| Top Mail 50 gsm | plain paper 50 gsm | heavy | low | V | yes |
| Red Label 80 gsm | plain paper 80 gsm | medium | medium | IV → III' | no |
| Soporset Premium 80 gsm | offset coated 80 gsm | heavy | medium | III | yes |
| Terra Print Silk 80 gsm | machine coated 80 gsm | medium | low | VI → 0' | no |
| Heavy plain paper | plain paper 110 gsm | low/none | stiff | 0 | no |
| Top coated Pro Gloss | coated 115 gsm | low/none | medium | 0 | no |

The stiffness of cut sheet materials may be measured according to ISO 2493-1:2010, wherein the bending angle is 15° and the bending length is preferably 50 mm. For cut sheets having a bending resistance (or stiffness) that is too low to measure with a bending length of 50 mm, a shorter bending length, i.e. 10 mm, can be used.

Figure 3B:
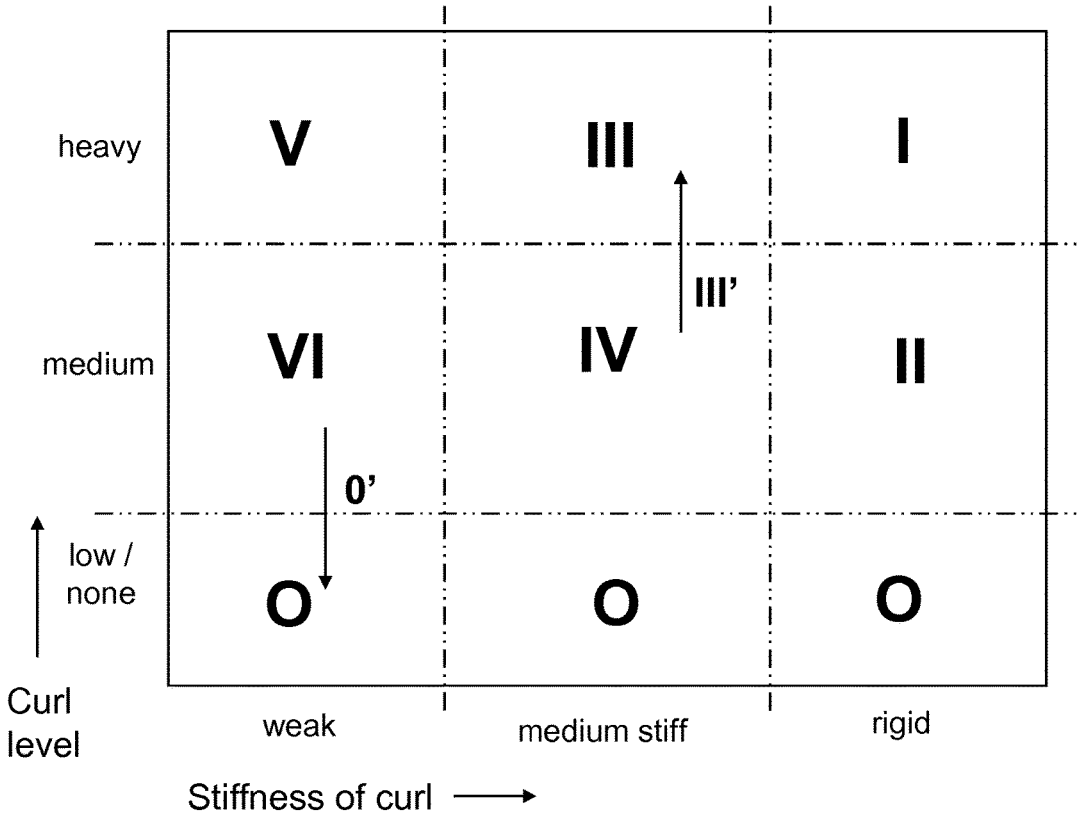
FIG. 3B shows a schematic view showing air flow states according to FIG. 3A depending on curl level and stiffness of the curl state of the sheet.

As can be seen coated and plain papers, which have a high stiffness, such as heavy plain paper 110 gsm, in general have a lower curl level. The higher stiffness of the sheet restricts a curl level and the curl deformation is withheld. As a result these papers may be processed without applying the air flow onto the process side of the sheet. However in case of a heavy material and stiff which has a medium curl level the appropriate air flow state is II as indicated in FIG. 3B.

To the Red Label 80 gsm the fourth air flow state IV is assigned. In this example the air flow state IV has been made equal to the air flow state III, related to heavy curl state and the same stiffness, which provides a higher air flow amplitude and/or duration, as is indicated by III'. The higher air flow amplitude and/or duration of the third air flow state III' can be used, thereby further flattening the curled sheet, while maintaining a good run ability of the sheet. As is indicated the air flow state III' in this example is not critical for run ability and may be reduced to a level of air flow state IV in case needed.

Figure 4:
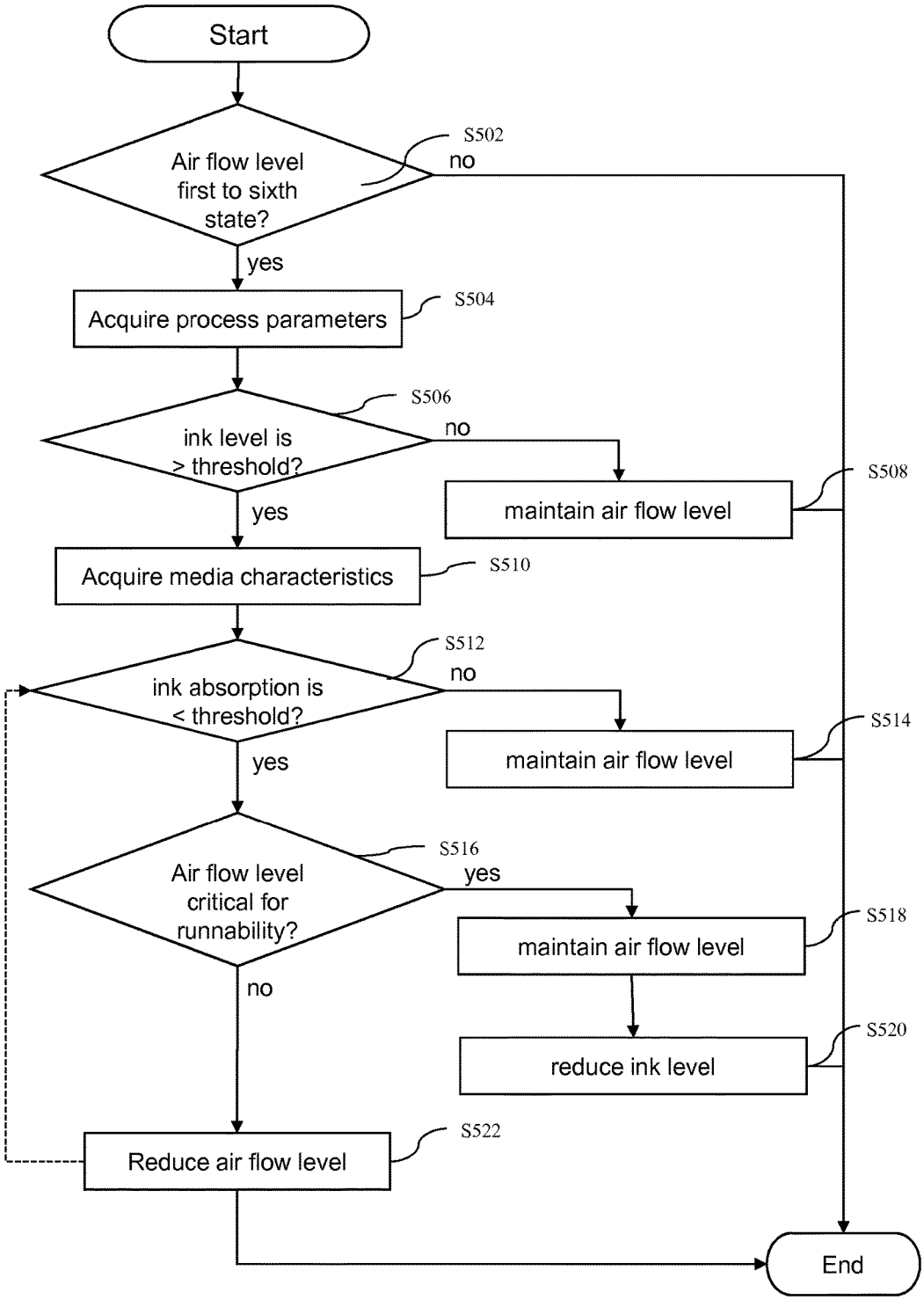
FIG. 4 shows in a flow diagram an embodiment of the method of according to the present invention.

Now referring to FIG. 4 which shows in a flow diagram an embodiment of the method according to the present invention. In this embodiment the state of the air flow may first be determined according to the flow diagram shown in FIG. 3A. In any way the flow diagram starts in case a state of the air flow is set by the control unit 300 for the sheet 20 based on curl deformation behavior of the sheet.

In step S502 it is judged whether the air flow level is assigned to be one of the first state I to sixth state VI. In case no, it is assumed that the air flow level is zero 0. In case yes, in step S504 the control unit 300 acquires process parameters of the sheet from the data controller 3, such as an ink coverage of the sheet. In step S506 it is judged whether the ink level (such as ink amount in gsm or ink coverage in percentage of a monolayer of ink) exceeds a certain threshold. In case no, the air flow state is maintained in step S508.

In case yes, in step S510 a material characteristic is acquired defining ink absorption speed of the sheet. In step S512 it is judged whether the ink absorption of the sheet speed is below a predetermined threshold level. For example the ink absorption speed of the sheet may be expressed in ml per second. Said predetermined threshold level may be predetermined based on a transport speed of the sheet, which may be acquired in step S504. For example the time ΔT between application of the ink coverage and the moment of the application of the air flow is determined and the threshold level for the ink absorption speed for sufficient ink absorption is based on said time ΔT and on the transport speed of the sheet between the print station and the air flow application position.

In case the answer in step S512 is no, the air flow state is maintained in step S514. In case yes, in step S516 it is judged whether the air flow level is critical for runnability of the sheet.

In case the answer in step S516 is yes, in step S518 the air flow state is maintained and in step S520 the ink amount is reduced by the data controller 3 in order to prevent ink bleed occurring due to the air flow applied to the processed sheet.

In case the answer in step S516 is no, in step S522 the air flow state is reduced one step. For example an air flow state III' for a Red Label plain paper may be reduced to the air flow state IV.

Optionally after step S522 the steps S510-S522 may be repeated, in case the ink absorption threshold is also critical for the air flow state which is obtained in step S522.

Now referring to FIGS. 5A-5B which show a sheet transfer assembly 60 comprising a sheet separating unit 180 for separating a sheet from the transport belt 11 of the supplying conveyor 10 operated according to the method of the present invention.

FIG. 5A shows an enlarged side view of both the supply conveyor 10 and the sheet transfer assembly 60 comprising the sheet separating unit 180, showing the transport belt 11 and one of the deflection rollers 13*c* of the supply conveyor 10. A sheet 20 is placed with a contact side on a support surface of the transport belt 14 and advanced by the transport belt 11 in a transport direction T by moving the transport belt in the transport direction T towards the deflection roller 13*c*. The sheet is attracted to the support surface of the transport belt 14 by a suction unit 15 which is arranged adjacent to the transport belt 11 for providing a suction pressure through holes of the transport belt 11 to the contact side of the sheet 20.

The sheet transport assembly 150 further comprises a sheet separating unit 180 comprising a leading edge air knife 100, a restrain air knife 200, a sheet guidance element 110, a separating control unit 300 and a sensor 320 and. Both the leading edge air knife 100 and the restrain air knife 200 are connected to an air supply source (not shown). The leading edge air knife 100 comprises a manifold 102 having an outlet 104 for directing a separation air flow A along the transport belt 11 adjacent to a circumferential surface of the deflection roller 13. The restrain air knife 200 comprises a manifold 202 having an outlet 204 for directing a restrain air flow S onto a process side of the sheet 23 for urging the sheet 20 towards the transport belt 11. The outlet 204 is arranged to direct the restrain air flow S substantially perpendicular to the transport direction T, such as at an angle of 70-110 degrees with respect to the transport direction T. This arrangement optimizes the restraining force applied by the restrain air flow S onto the process side of the sheet 23. The restrain air knife 200 is arranged upstream of the leading edge air knife 100 in the transport direction T for applying said restrain air flow S onto the process side of the sheet 23 upstream in the transport direction T with respect to the leading edge air knife 100 applying the separation air flow A onto a leading edge of the sheet 22. The distance between the restrain air knife 200 applying the restrain air flow S and the leading edge air knife 100 applying the separation air flow A on the sheet 20 is in the range of 5 mm to 40 mm.

A leading edge of the sheet 22 arrives at the deflection roller 13 and travels in the transport direction T while at the same position the transport belt 11 is deflected away from the transport direction T by the rotating deflection roller 13*c*. At this position the separation air flow A is directed towards the leading edge 22 to lift the leading edge of the sheet 22 from the transport belt 11.

In FIG. 5A a first stage of a method of operating the separating unit 180 is shown, wherein a curled portion of the sheet 24 arrives at the restrain air knife 200. The leading edge of the sheet 22 has been detected upstream of the restrain air knife 200 by sensor 320. The sensor 320 is configured for detecting the leading edge of the sheet 22 and provides a timing signal to the separation control unit 300. The separation control unit 300 controls the leading edge air knife 100 and the restrain air knife 200 according to the method of the present invention. The separation control unit 300 controls the restrain air knife 200 for applying the restrain flow B onto a process side of the sheet 23 so that the downward curled portion of the sheet 24 is pushed towards the support surface of the transport belt 14 by the restrain flow S. The air flow is controlled in response to a media characteristic which defines the curl deformation of the sheet 20 behavior during the separation step.

In a second stage of the method of operating the separating unit 180, the leading edge of the sheet 22 arrives at position where the separation air flow A contacts the leading edge 22. The curled portion of the sheet 24 is pushed towards the transport belt by the restrain air knife 200. The separation control unit 300 controls the leading edge air knife 100 for applying the separation air flow A along the transport belt 11 to the leading edge 22 to lift the leading edge 22 away from the support surface of the transport belt 14. After the second stage the separation control unit 300 controls the restrain air knife 200 to stop the restrain air flow S after the leading edge of the sheet 22 has been lifted from the support surface of the transport belt 14 by the leading edge air knife 100 and the guidance edges 114 (see FIG. 5B). The leading edge 22 has passed the position where the separation air flow A contacts the sheet 20.

The separation control unit 300 controls the leading edge air knife 100 to maintain the separation air flow A until the leading edge 22 has reached a next transport element 40, such as a transport belt 42 shown in FIG. 1, downstream in the transport direction T. The transport belt advances the sheet 20 further in the direction R.

Now referring to FIG. 5B wherein a plane view is shown of the separating unit 180. The restrain air knife 200 directs the restrain air flow S onto the process side of the sheet 23 in an area of the support surface 14 of the transport belt 11 of the supplying conveyor 10.

The sheet guidance element 110 is arranged facing the support surface of the transport belt 14 proximate to the deflection roller 13*c*. As shown in FIG. 5B the sheet guidance element 110 comprises separation needles 112, guidance edges 114 and a support surface 120 which comprises openings 118. The separation needles 114 are arranged protruding from the support surface 120 of the sheet guidance element 110 close to the support surface of the transport belt 14 and are configured for lifting the leading edge of the sheet 22 away from the transport belt 11. The separation needles 112 may be arranged contacting the support surface of the sheet transport belt 14 or may be arranged at a close distance, such as about 0.1-0.3 mm. The separation needles 112 are distributed over a middle section of the transport belt 11 in a lateral direction Y, which is perpendicular to the transport direction T. The separation needles 112 comprises support surfaces (not shown) arranged for guiding the contact side of the sheet 20 towards the support surface 120 of the sheet guidance element 110.

The guidance edges 114 are arranged at each side of the distributed separation needles 112 in the lateral direction Y. Each guidance edge 114 is arranged at an acute angle α with respect to the lateral direction Y, wherein said angle α is about 10-30 degrees. The guidance edges 114 are arranged for guiding the leading edge 22 and side edges of the sheet 20 onto the support surface of the sheet guidance element 120. Especially in case corners of the sheet 20 at the leading edge 22 are curled downwards towards the transport belt 11, the guidance edges 114 guide the corners of the sheet 20 onto the support surface of the sheet guidance element 120.

Now referring to FIGS. 6A-6B which show a sheet transfer assembly 60 comprising a sheet landing unit 280 for moving the sheet onto the transport belt 42 of the receiving conveyor 40 operated according to the method of the present invention.

FIG. 6A shows an enlarged side view of both the supply conveyor 10 and the sheet landing unit 280, showing the transport belt 11 and one of the deflection rollers 13*c* of the supply conveyor 10, and the receiving conveyor 40, showing the transport belt 42, one of the belt rollers 44 and the suction unit 46.

The sheet landing unit 280 comprises the sheet guidance element 110 shown in the embodiment shown in FIG. 5A-5B and additionally comprises a landing air knife 140 being coupled to an air supply source (not shown). The sheet guidance element 110 comprises a guidance surface 120 arranged for supporting the sheet 20 in contact with the contact side 21 of the sheet 20 and guiding the sheet 20 along the sheet guidance element 110 towards the receiving conveyor 40.

The air knife 140 is arranged for applying an air flow L onto a process side 23 of the sheet, the process side 23 being opposite to the contact side 21, thereby urging the sheet 20 with its contact side 21 onto the support surface 43 of the transport belt 42. The landing air knife 140 comprises a manifold outlet 144 arranged substantially perpendicular to the process side 23 of the sheet proximate to the two guide faces 130*a*, 130*b* and facing the support surface 43 of the transport belt 42.

Now referring to FIG. 6B showing a plane view on the sheet landing unit 280 on the guidance surface 120 of the sheet guidance element 110 and the support surface of the transport belt 42. The guidance surface 120 of the sheet guidance element 110 is arranged partly over the transport belt 42 of the receiving conveyor 40. Behind the rear end of the guidance surface 122 in the transport direction the sheet 20 is allowed to land on the support surface of the transport belt 42 of the receiving conveyor 40. The guidance surface 120 comprises two guide faces 130*a*, 130*b* extending in the transport direction T over the support surface 43 of the transport belt 42 and being cooperatively arranged for supporting both side edge portions 26 at each side of the sheet 20 relative to a lateral direction L, which is substantially perpendicular to the transport direction T, thereby forming a space 132 in between the two guide faces 130*a*, 130*b* allowing a middle portion 28 of the sheet to move towards the support surface 43 of the transport belt 42.

In this view the sheet 20 is held partly by the supplying conveyor 10, in part is supported by the guidance surface 120 and in part has landed on the support surface of the transport belt 42 of the receiving conveyor 40. The leading edge of the sheet 22 is moved past the guidance surface 120 of the sheet guidance element 110.

The air flow L is directed in a landing area L proximate to the two guide faces 130*a*, 130*b* onto the process side of the sheet 20 downstream of the guidance surface 120. The landing area L extends in the lateral direction Y over the middle portion of the sheet 28. The landing area L also extends in the lateral direction Y along the space 132 between the two guide faces 130*a*, 130*b*.

The receiving conveyor 40 comprises a suction unit 46 which is arranged for providing a suction force through holes of the transport belt 42 to the contact side of the sheet 21. The contact side of the sheet 21 is attracted onto the support surface 43 of the transport belt 42 in a suction area 45. The suction area 45 is arranged such that it at least partly overlaps the landing area L provided by the landing air knife 140.

Detailed embodiments of the present invention are disclosed herein; however, it is to be understood that the disclosed embodiments are merely exemplary of the present invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the present invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A method for transferring a sheet in a sheet transport assembly from a supplying conveyor to a receiving conveyor, the method comprising the steps of:

a) arranging a contact side of a sheet in contact with a transport belt of the supplying conveyor;

b) advancing the sheet on the transport belt of the supplying conveyor in a transport direction along a process unit, which is arranged for applying a process to a process side of the sheet, the process side being opposite to the contact side, to a transfer area where the sheet is transferred to a transport belt of the receiving conveyor, the transfer area comprising a supporting element for supporting the sheet during transport in the transfer area;

c) acquiring a media characteristic of the sheet, said media characteristic defining a curl deformation behavior of the sheet; and d) controlling a sheet blowing unit in the transfer area to direct an air flow onto the process side of sheet for urging the sheet towards the transport belt of the supplying conveyor, thereby correcting a curl deformation of the sheet, the air flow being controlled in response to the media characteristic of the sheet.

2. The method according to claim 1, wherein said curl deformation behavior comprises a curl level.

3. The method according to claim 1, wherein said curl deformation behavior comprises a stiffness of the curl state.

4. The method according to claim 1, wherein step d) comprises directing the air flow substantially perpendicular to the process side of the sheet.

5. The method according to claim 1, wherein step b) further comprises a step of applying inkjet droplets onto the process side of the sheet.

6. The method according to claim 5, wherein said air flow is further controlled in response to an ink coverage resulting from the applied inkjet droplets.

7. The method according to claim 6, wherein said air flow is controlled based on ink absorption of the process side of the sheet in response to the ink coverage.

8. The method according to claim 1, wherein the supporting element is a sheet guidance element comprising separation needles for lifting leading edges of the sheet from the transport belt of the supplying conveyor, guidance edges for guiding the leading edges and side edges of the sheet and a support surface for supporting the sheet.

9. A sheet transport assembly for transferring a sheet between two conveyors, the sheet transport assembly comprising:

a supplying conveyor comprising a transport belt, the supplying conveying being configured for advancing the sheet in a transport direction along a process unit, which is configured for applying a process to a process side of the sheet, to a transfer area for transferring the sheet to the transport belt of a receiving conveyor, the sheet having a contact side in contact with the transport belt, wherein the transfer area comprises a supporting element for supporting the sheet during transport in the transfer area;

a sheet blowing unit coupled to an air supply source, which sheet blowing unit comprises an air knife arranged for directing an air flow onto the process side of the sheet, the process side being opposite to the contact side, for urging the sheet towards a supporting element for supporting the sheet during its transport in the transfer area;

wherein the sheet transport assembly further comprises a control unit configured for controlling the sheet blowing unit in response to at least one sheet attribute of the sheet comprising a media characteristic of the sheet, wherein said media characteristic defines a curl deformation behavior of the sheet.

10. The sheet transport assembly according to claim 9, wherein the control unit is coupled to a media database, which comprises a list of media characteristics related to curl deformation behavior of the sheet.

11. The sheet transport assembly according to claim 9, wherein the air knife is a restrain air knife arranged for directing a restrain air flow onto the process side of the sheet for urging a curled portion of the sheet towards the transport belt of the supplying conveyer.

12. The sheet transport assembly according to claim 9, wherein the sheet blowing unit further comprises a landing air knife arranged for applying a landing air flow onto the process side of the sheet to urge the contact side of the sheet onto a transport belt of the receiving conveyor.

13. An inkjet printing apparatus comprising the sheet transport assembly according to claim 9 and a print station comprising a print head assembly configured for in operation applying inkjet droplets on the process side of the sheet, which is arranged on the transport belt.

* * * * *